US005217289A

United States Patent [19]

Woodward et al.

[11] Patent Number: 5,217,289

[45] Date of Patent: * Jun. 8, 1993

[54] TAMBOUR DOOR OF WOOD COMPOSITION BOARDS AND VENEERS HAVING PRESSED DESIGN THEREIN AND METHOD OF MAKING

[75] Inventors: Bruce Woodward, Louisville; Richard Mazzoli, Jeffersontown, both of Ky.

[73] Assignee: National Products, Inc., Louisville, Ky.

[ * ] Notice: The portion of the term of this patent subsequent to Oct. 29, 2008 has been disclaimed.

[21] Appl. No.: 870,400

[22] Filed: Apr. 17, 1992

[51] Int. Cl.[5] ..... E06B 9/15

[52] U.S. Cl. ..... 312/297

[58] Field of Search ..... 312/297; D6/442, 492, D6/448; 144/345, 350, 355; 156/264, 265, 227

[56] References Cited

U.S. PATENT DOCUMENTS 5,060,705 10/1991 Woodward et al. ..... 312/297 X 5,066,080 11/1991 Woodward et al. ..... 312/297

*Primary Examiner*—Peter R. Brown

*Attorney, Agent, or Firm*—Charles G. Lamb

[57] ABSTRACT

A tambour door includes a plurality of elongated elements having front and back surfaces of rectangular transverse cross-section placed in abutting side-by-side relationship including a flexible backing material overlaying and adhesively secured to the back surfaces of the elongated elements. The elongated elements are cut from a single panel formed of a wood composition board core having a thin veneer sheet attached to at least one face. The front surface of the elongated elements are formed with a design which extends over a plurality of adjacent elements. The design is pressed into the door, stretching and compressing the veneer rather than tearing it. The design depth can be approximately 1½ times the veneer thickness. A cabinet including such tambour doors includes side pockets in which the doors move on tracks when the doors are moved to the open position. When the doors are in the closed position, they are planar and extend across the opening into the cabinet. When the door is in the closed position, the interface between adjacent elements is virtually invisible because the abutting relationship of the elements and because of their rectangular cross-sectional shape.

10 Claims, 2 Drawing Sheets

TAMBOUR DOOR OF WOOD COMPOSITION BOARDS AND VENEERS HAVING PRESSED DESIGN THEREIN AND METHOD OF MAKING

BACKGROUND OF THE INVENTION (a) Field of the Invention

The present invention relates to a tambour door wherein the door, when in use, gives a solid appearance, and more particularly may include a design which is pressed or stamped into the tambour door face surface. The tambour door of the present invention has a wood composition board core with at least a veneer face surface.

(b) Description of the Prior Art

In the manufacture of heretofore known tambour doors, small strips of wood having tapered, chamfered, or rounded edges are placed in a touching relation and are held together by adhesively securing these pieces of wood to a flexible backing material, usually cloth. Generally, tambour doors are assembled from a random selection of wood strips cut from wood panels. And, the wood panels themselves are cut from different parts of a log. Therefore, the wood grain and color of adjacent wood strips do not match. The transversely extending grooves in these tambour doors formed by the tapered chamfered or rounded edges of the individual strips is, therefore, necessary to mask or disguise the mismatching grains and color of the wood strips. The resulting sheet which includes a plurality of transversely extending grooves thereacross, has been used for many years in roll-top desks, flexible-type closures for entertainment centers, and similar type applications.

In our U.S. Pat. Nos. 5,060,705 and 5,066,080, we teach a tambour door with a solid appearance and a method for making the solid appearance tambour door. In those patents, a tambour door is described which is made from a plurality of rectangular-shaped members. These members are fabricated of, for example, solid wood, hard board, and wood laminated fiberboard. A design is formed in the face surface of the plurality of adjoining members by routing, carving, pressing, and the like. With a laminated type tambour door, designs can not be routed or carved, because doing so would pierce the laminated surface and leave the unattractive interior substrate core exposed, which is not desirable. Pressing can tear the thin laminates and cause the same problem, unless the pressing is controlled to a preselected pressure or depth into the laminated tambour door.

SUMMARY OF THE INVENTION

The present invention provides a tambour door with a solid appearance. More particularly, the present invention provides a tambour door with a raised panel appearance. Even more particularly, the present invention provides a tambour door with an appearance and design comparative to solid doors. Furthermore, the present invention provides a tambour door with a solid appearance for a cabinet wherein the opening for the door to depth of the cabinet can be in a magnitude ratio of about three to one.

More particular, the present invention provides a tambour door comprised of a plurality of rectangular-shaped members having face and back surfaces aligned in an abutting side-by-side relationship adhesively secured to a flexible backing material with a deign on the face of the plurality of the rectangular-shaped members.

Even more particularly, the present invention provides a tambour door comprising a plurality of elongated parallel wood members, each member having a rectangular-shaped transverse cross-section, a front surface, a back surface, and sides substantially perpendicular to the front surface, the adjacent elongated members being aligned in an abutting side-by-side relationship, the elongated members having been cut from a single panel. The single panel comprises a wood composition board substrate which includes, for example, substrates of fiberboard, or the like, with relatively thin veneer attached to the substrate and covering at least one of the substrate surfaces which would be visible in the finished tambour door. The elongated members are oriented in the same relationship one to the other as they were when originally cut from the panel such that the grain in the veneer of each elongated member substantially mates with the grain in the veneer of an adjacent elongated member at the interface therebetween whereby the interface between adjacent members is indistinct, and the front surfaces of the individual elongated members cooperate forming a planar overall surface providing an appearance of a solid panel, and a flexible backing material coextensive with the plurality of side-by-side elongated members adhesively attached to the rear surfaces of the elongated members.

Furthermore, the present invention provides a method of making a tambour door comprising the steps of placing a plurality of rectangular-shaped members having a face and a back in a side-by-side abutting relationship, attaching the members to a sheet of flexible material overlaying the backs of the members, finishing the face surfaces of the members to a smooth finish and a uniform thickness, and, forming a design in the face surface of the members.

The design in the face surface of the veneer covered wood composition board is formed by stamping or pressing, under controlled conditions, the design into the face surface to a predetermined depth, this depth being such that the veneer will stretch without tearing.

BRIEF DESCRIPTION OF THE DRAWINGS

A better understanding of the invention will be had upon reference to the following description in conjunction with the accompanying drawings wherein like numerals refer to the parts throughout the several views and in which.

DETAILED DESCRIPTION OF THE PREFERRED EMBODIMENT

Figure 1:
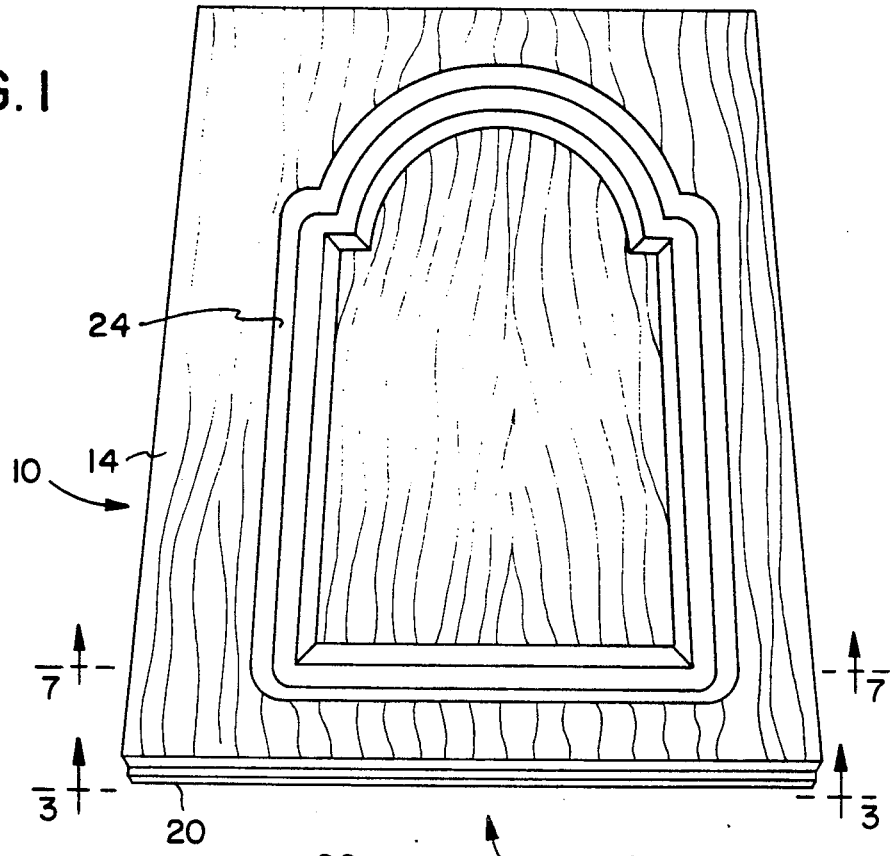
FIG. 1 is a front view of a tambour door of the present invention as it appears in the closed position.
Figure 2:
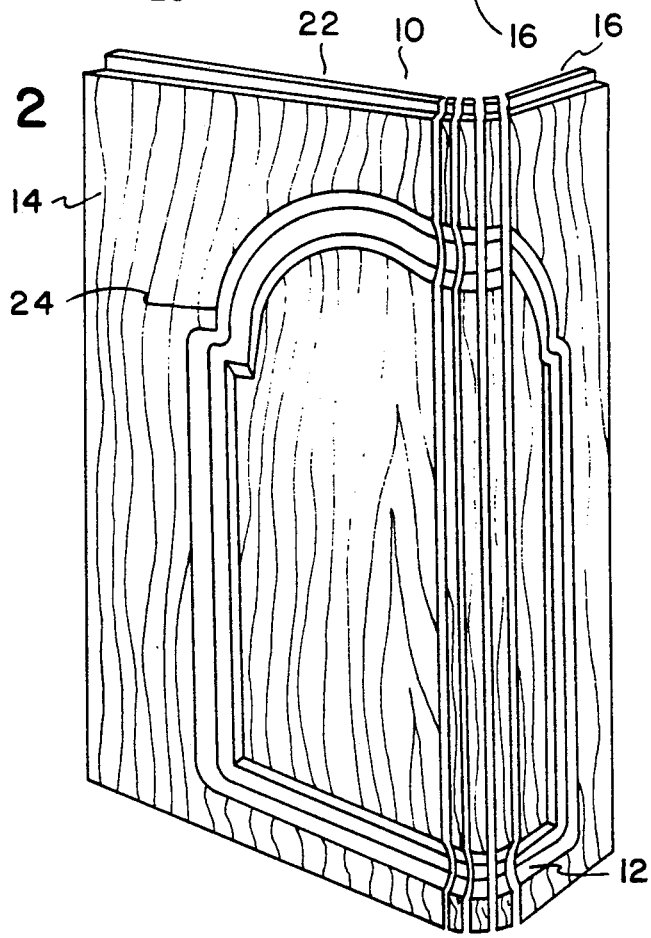
FIG. 2 is a perspective view of the tambour door as it appears when being moved to an open position.
Figure 3:
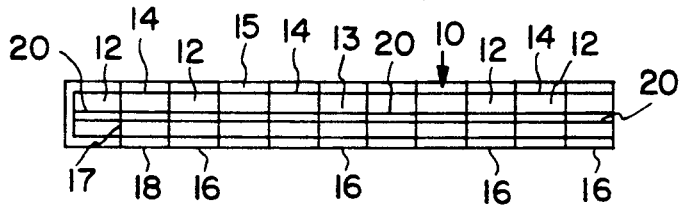
FIG. 3*a* side view of the door of FIG. 1 as seen in the direction of arrows 3—3 in FIG. 1.

With reference to FIGS. 1-3 and 7, there is shown a tambour door, generally denoted by the numeral 10, of the present invention which when in a planar configuration extends across and closes an opening to give the appearance of a solid or one-piece constructed door. Toward this objective, the tambour door 10 comprises a plurality of elongated members 12 each of rectangular transverse cross-section having a surface 14, a back surface 16 and sides 17. The elongated members 12 of the present invention are cut from a single panel. The single panel comprises a wood composition board substrate core 13 with relatively thin veneer 15 attached, for example, by glueing, to the substrate 13. The veneer 15 is attached to at least the surface of the substrate 13 which would be visible in the finished tambour door 10, as installed in a cabinet or the like.

The elongated members 12 are oriented in abutting side-by-side relation in the same relationship, one to the other, as they were when originally cut from the panel with the sides 17 of the members 12 remaining as cut or unfinished such that the grain of the veneer 15 of each elongated member substantially mates with the grain of the veneer on an adjacent elongated member 12 at the interface therebetween. Therefore, the interface between adjacent member 12 is indistinct, and the front surfaces 14 of the individual elongated members cooperate to form a planar overall door surface providing an appearance of a solid panel which has no break or interruption.

Preferably, the elongated members 12 of the tambour door 10 are cut from a single panel by gang ripping the panel into the members 12 so that the same saw blade cuts the adjoining or adjacent sides of the adjacent members 12. Therefore, any variations in the saw blade are mirrored in adjoining or adjacent sides of adjacent members 12 making cutting variations indistinct at the interface of said adjacent members.

A sheet of flexible material 18 overlays and is adhesively secured to the back surface 16 of the elongated members 12. Back surface 16 ma be just the wood composition board core 13 surface itself or may be a sheet of veneer, identified by the numeral 15. The backing sheet 18 holds the members 12 together in abutting side-by-side relationship when the door 10 is in the planar closed position, and allows the members 12 to pivot relative to each other about a pivot axis coinciding with the interface between adjacent members 12 as the door is moved to an open position. Therefore, the front surfaces 14 of the elongated members 12 are mutually flush or planar and therefore, the tambour door 10 has the appearance of a solid door.

Figure 7:
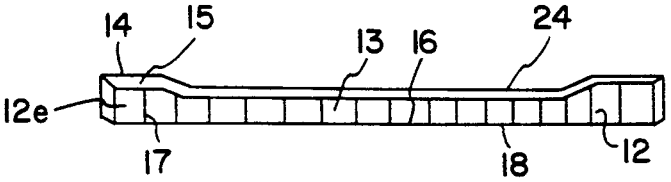

The side 17 of the end elongated member 12, shown as **12*e* in FIG. 7, of tambour door 10 which will abut another tambour door in a dual door cabinet, as described hereinafter, the door 10 may also have Veneer 15 attached so that the wood composition board core 13 is not visible when the dual doors are separated. The flexible sheet material 18 can be, for example, a cloth material, such as cotton, 50-50 cotton polyester blend, high strength paper and the like. The flexible sheet material 18 can be bonded to the members 12 by a suitable adhesive which will be dictated by the type of back surface 16 of members 12 and flexible sheet 18**.

The members 12 include a first or bottom flange or tenon 20 at the bottom edges of the members 12 which cooperate in end-to-end relationship to extend along the bottom edge of the door 10. The members 12 also have a second or top flange of tenon 22 at the top edges of the members 12 which cooperate in end-to-end relationship to extend along the top edge of the door 10.

The tambour door 10 advantageously includes a design 24 formed in the face surface 14 of the elongated members 12. The design 24 is a continuous design which is formed in a plurality of adjacent elongated members 12 extending across the interface of adjacent elongated members 12 such that segments or the design 24 are formed in adjacent elongated members 12 and mate at the interface of adjacent members 12. Therefore, the continuous design 24 extends across at least a portion of the width and length of the door 10. The design 24 is pressed or stamped into the door 10, to a predetermined depth, based on the veneer 15 thickness so that the veneer stretches and compresses without tearing and thereby exposing the wood composition board core 13.

Typically, in the preferred embodiment, ¼" thick wood composition board core 13 is used and faced with veneer 15, having a thickness on the order of 1/30" to 1/60". Experience has shown that design 24 can be pressed or stamped into the veneer 15 to a depth of up to about 1½ times the thickness of the veneer 15. For example, with 1/30" thick veneer 15, we have found that we can stamp a design 24 indenting door 10 to a depth of 3/64". The design 24 stamp is provided with curved surfaces where it impacts face 14 so that veneer 15 stretches and compresses instead of tearing. The depth of the design 24 and thickness and composition of wood composition board 13 and veneer 15 will determine how much core 13 and veneer 15 stretch and compress.

Design 24 can be pressed or stamped either before or after the single panel is cut to form elongated members 12, though the later is recommended. If pressed or stamped after members 12 have been cut from the single panel, during the pressing or stamping of the design, all of the rectangular-shaped members 12 are clamped or otherwise held in a non-moveable situation. Thus, when the tambour door 10 is in the planar configuration, the segments of the design in the adjacent elongated members 12 have continuity forming the completed design 24 thus even further increasing the perception that the tambour door 10 is a solid door.

Figure 4:
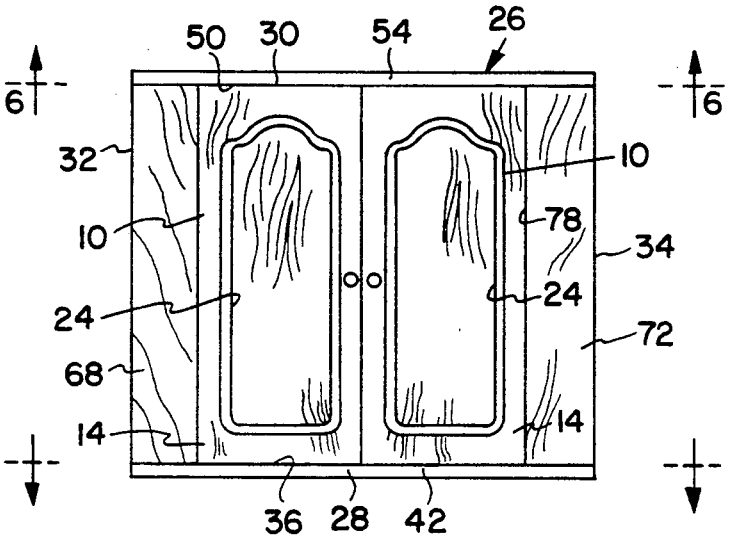
FIG. 4 is a front view of a cabinet including the tambour doors of FIG. 1.
Figure 5:
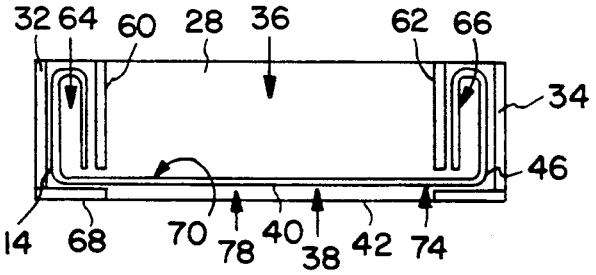
FIG. 5 is a cross-sectional view of the cabinet in FIG. 4 as seen in the direction of arrows 5—5 in FIG. 4.
Figure 6:
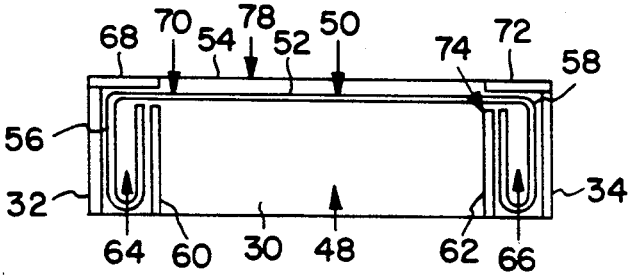
FIG. 6 is a cross-sectional view of the cabinet of FIG. 4 as seen in the direction of arrows 6—6 in FIG. 4; and, FIG. 7 is a cross-sectional side view of a tambour door of the present invention as seen in the direction of arrows 7—7 in FIG. 1.

The tambour door 10 is used to open and close the front opening of, for example, a cabinet 26 as shown in FIGS. 4-6. The cabinet 26 is of the type having a bottom panel 28, a top panel 30 spaced above the bottom panel 28, and outer side panels 32 and 34 extending between the bottom panel 28 and top panel 30 closing the ends of the cabinet 26. The top or inside surface 36 of the bottom panel 28 has a bottom door track 38 of plastic enlayed in the track 38 which has a straight intermediate portion 40 extending along the length of the bottom panel 28 proximate the front edge 42 of the bottom panel 28. Track 38 is also provided with curved end sections 44 and 46 at opposite ends of the intermediate portion 40 proximate the outer side panels 32 and 34 respectively. The bottom or inside surface 48 of the top panel 30 has a top door track 50 which has a straight intermediate portion 52 extending along the length of the top panel 30 proximate the front edge 54 of the top panel 30. Track 50 is also provided with curved end sections 56 and 58 at the opposite ends of the intermediate portion 52 proximate the outer side panels 32 and 34, respectively. The bottom door track 38 is in registration with the top door track 50.

The cabinet 26 also includes inner side panels 60 and 62 parallel to and spaced apart from the outer side panels 32 and 34, respectively. Panels 60 and 62 also extend between and are connected to the bottom panel 28 and the top panel 30. Thus, the outer side panel 32 cooperates with the inner side panel 60 to define a pocket 64, and the outer side panel 34 and inner side panel 62 cooperate to define a pocket 66. Each of the pockets 66 and 64 are adapted to receive a tambour door 10 therein. The front edge of the inner side panel 60 adjacent to the outer side panel 32 terminates a short distance behind the front edge of the outer side panel 32, and the inner panel 62 adjacent the outer side panel 32, and the inner panel 62 adjacent the outer panel 34 terminates a short distance behind the front edge of the outer side panel 34. The curved end section 44 of the bottom door track 38 and the curved end section 56 of the top door track 50 are located in the pocket 64 between the adjacent outer side panel 32 and inner side panel 60, and the curved end section 46 of the bottom door track 38 and the curved end section 58 of the top door track 50 are located in the pocket 66 between the adjacent outer side panel 34 and inner side panel 62. A short front panel 68 is located across the front edge of the pocket 64 and cooperates with the front edge of the inner side panel 60 to define a door slit 70 therebetween open to the pocket 64. A short front panel 72 is located across the front of the pocket 66 and cooperates with the front edge of the inner side panel 62 to define a door slit 74 therebetween open to the pocket 66.

The tambour door 10 is positioned in the cabinet 26 with the bottom flange 20 received in the bottom door track 38 and the top flange 22 received in the top door track 50 which also includes a plastic inlay therein. This enables the door 10 to move in the bottom and top door tracks 38 and 50 between a closed planar position in which the door 10 extends across the cabinet opening 78, and an open position away from the cabinet opening 78 thereby providing access to the interior of the cabinet 26. As shown, the cabinet 26 has two identical tambour doors 10 which when closed are coplanar, extend along the straight intermediate portions 40 and 52 of the bottom and top door tracks 38 and 50, and interface at the vertical centerline of the cabinet opening 78 each door 10 presenting an appearance of a solid door. To open the cabinet 26, the two doors 20 are moved in opposite directions to each other in the bottom and top door tracks 38 and 50 through the door slits 70 and 74 to the open position so that each door 10 is moved away from the cabinet opening 78 occupying the pockets 64 and 66, respectively. Toward this objective, the curved end sections 44, 46 of the bottom track 38 and the curved end section 56, 58 of the top track 50 each have an overall length at least equal to the width of a door 10 so that when in the open position the doors 10 are each totally enclosed in the appropriate pocket 64, 66 and hidden from view. As is evident from FIGS. 4, 5 and 6, it should be clearly noted that as the doors 10 are moved between the open and closed positions only the portion of the doors 10 moving in the intermediate straight track portions 40 and 52 of the bottom and top door tracks 38 and 40, respectively, across the front of the cabinet 26 between the pockets 64 and 66 ar visible. One portion of the door 10 moving in the curved end sections 44, 56 of the bottom and top door tracks 38 and 50, respectively, is inside the pocket 64 and a portion of another door 10 moving in the curved end sections 46 and 58 of the bottom and top door tracks 38 and 50, respectively, is inside the pocket 66. Thus, these portions of the two doors 10 are hidden from view. The elongated members 12 of the tambour doors 10 pivot relative to each other at the interface between adjacent members only when they move through the curved end sections of the bottom and top track 38 and 50, respectively, inside the pockets 64 and 66, and are not visible. Only the portions of the tambour doors 10 in the intermediate track portions 40 and 52 are visible, and the elongated members 12 of the tambour doors 10 in the intermediate track portions 40 and 52 are in abutting side-by-side planar relationship with their front surfaces 14 mutually flush or planar. Therefore, regardless of the position of the tambour doors 10 in the cabinet 26 between fully closed and fully open positions, that portion of the door visible to the front opening of the cabinet always presents an appearance of a solid door. A striking illusion provided by this novel construction is that the tambour doors 10 appear to be solid sliding doors as they move between open and closed positions, but because the cabinet 26 is not wide enough to accommodate sliding doors, the doors seem to disappear into a space which is too small for the doors.

With further reference to FIGS. 5 and 6, the curved end sections 44, 46 of the bottom track 38 and the curved end sections 56, 58 of the top track 50 can follow virtually any convenient path. As show, the curved end sections 44, 46, 56 and 58 follow a loop path into the pockets 64, 66 respectively, with the end of the track adjacent the straight portion of the track near the slit 70, 74. Thus, when the doors 10 are in their open position, they are each doubled back over themselves conforming to the looped shape of the curved track end sections which allow for a cabinet 76 to be of small depth or front to back dimension. In the exemplified cabinet in FIGS. 4–6, the opening for the door to depth of the cabinet is in a ratio of about three to one.

The foregoing detailed description is given primarily for clearness of understanding and no unnecessary limitations are to be understood therefrom for modifications will become obvious to those skilled in the art upon reading this disclosure and may be made without department from the spirit of the invention and scope of the appended claims.

We claim:

1. A tambour door comprising:

a plurality of elongated parallel members, each member having a rectangular-shaped transverse cross-section, a front surface, a back surface, and sides substantially perpendicular to the front surface, the adjacent elongated members being aligned in an abutting side-by-side relationship, the elongated members having been cut from a single panel, said single panel having a wood composition board core and a sheet of veneer attached to at least a face of said wood composition board core, said elongated members oriented in the same relationship one to the other as they were when originally cut from the panel, with the sides of the elongated members remaining unfinished as originally cut from the panel, such that the grain of the veneer of each elongated member substantially mates with the grain of the veneer of an adjacent elongated member at the interface therebetween whereby the interface between adjacent members is indistinct, and the front surfaces of the individual elongated members cooperate forming a planar overall surface providing an appearance of a solid panel;

a flexible backing material coextensive with the plurality of side-by-side elongated members adhesively attached to the back surfaces of the elongated members; and a design pressed in the front surface of the elongated members to a predetermined depth.

2. The tambour door of claim 1, wherein the design is a continuous design in a plurality of adjacent elongated members extending across the interface of adjacent elongated members such that segments of the design in adjacent elongated members mate at the interface of adjacent members and the design segments cooperate to form the continuous design extending across at least a portion of the width and length of the door.

3. The tambour door of claim 1, wherein the wood composition board core has a thickness of ¼ inch.

4. The tambour door of claim 3, wherein the veneer has a thickness of between 1/50" to 1/30" and wherein the predetermined depth of the design pressed in the front surface does not exceed 3/64".

5. The tambour door of claim 1, wherein the veneer has a thickness of between 1/50" to 1/30".

6. The tambour door of claim 5, wherein the predetermined depth of the design pressed in the front surface does not exceed 1½ times the veneer thickness.

7. The tambour door of claim 1 wherein the wood composition board is particle board.

8. The tambour door of claim 1 wherein the wood composition board is fiberboard.

9. A method making a tambour door comprising the steps of:

placing a plurality of members of rectangular-shaped cross-section having a wood composition board core and veneer face and a back surface in a side-by-side abutting relationship;

attaching the members to a sheet of flexible material overlaying the back surface of the members;

finishing the face surface of members to a smooth finish and to a uniform thickness; and forming a design in the face surface of the members by pressing the design to a predetermined depth.

10. A method making a tambour door comprising the steps of:

forming a design in a face surface of a panel having a wood composition board core, a veneer face and a back surface, by pressing the design to a predetermined depth;

cutting said panel having a design therein into a plurality of members of rectangular-shaped cross-section and placing said members in a side-by-side abutting relationship so that the members have a same relative location to each other as they did as part of the unitary panel;

attaching the members to a sheet of flexible material overlaying the back surface of the members; and, finishing the face surface of members to a smooth finish and to a uniform thickness.

* * * * *